US010319310B2

(12) United States Patent
Kim et al.

(10) Patent No.: US 10,319,310 B2
(45) Date of Patent: Jun. 11, 2019

(54) DISPLAY DEVICE

(71) Applicant: Samsung Display Co., Ltd., Yongin-si, Gyeonggi-do (KR)

(72) Inventors: Jung-taek Kim, Seoul (KR); Kyoungwon Lee, Seoul (KR); Joon-chul Goh, Hwaseong-si (KR); Youngwoo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 253 days.

(21) Appl. No.: 15/242,454

(22) Filed: Aug. 19, 2016

(65) Prior Publication Data

US 2017/0124985 A1 May 4, 2017

(30) Foreign Application Priority Data

Oct. 29, 2015 (KR) ..... 10-2015-0151343

(51) Int. Cl.
*G09G 5/10* (2006.01)
*G09G 3/34* (2006.01)

(52) U.S. Cl.
CPC ..... *G09G 3/34* (2013.01); *G09G 2310/027* (2013.01); *G09G 2310/08* (2013.01); *G09G 2320/0276* (2013.01); *G09G 2320/0646* (2013.01); *G09G 2320/0673* (2013.01); *G09G 2330/021* (2013.01)

(58) Field of Classification Search
CPC ..... G09G 3/34; G09G 2310/08; G09G 2310/027; G09G 2320/0276; G09G 2320/0646; G09G 2320/0673; G09G 2330/021; G09G 5/10
See application file for complete search history.

(56) References Cited

U.S. PATENT DOCUMENTS 6,340,996 B1 * 1/2002 Nakamura ..... H04N 5/66 348/675
6,798,368 B2 * 9/2004 Jung ..... G09G 3/3688 341/118

(Continued)

FOREIGN PATENT DOCUMENTS

KR 10-20050014263 2/2005
KR 10-2010-0006790 1/2010

(Continued)

*Primary Examiner* — Benyam Ketema
(74) *Attorney, Agent, or Firm* — Lewis Roca Rothgerber Christie LLP

(57) ABSTRACT

A display device includes: a display panel including first group pixels connected to a first gate line to receive first data voltages, and second group pixels connected to the first gate line to receive second data voltages; a backlight source to provide light to the display panel; a signal controller to divide horizontal image signals into first group image signals and second group image signals, to extract a first maximum grayscale image signal from the first group image signals, and to extract a second maximum grayscale image signal from the second group image signals; a power supply to generate first and second gamma driving voltages from a reference gamma driving voltage based on a grayscale level of the first maximum grayscale image signal and a grayscale level of the second maximum grayscale image signal.

20 Claims, 15 Drawing Sheets

(56) References Cited

U.S. PATENT DOCUMENTS

| | | | | |
|---|---|---|---|---|
| 8,310,426 | B2 * | 11/2012 | Umeda | G09G 3/3648 345/690 |
| 2003/0063053 | A1 * | 4/2003 | Yamazaki | G09G 3/3241 345/82 |
| 2004/0113923 | A1 * | 6/2004 | Ha | G09G 3/3208 345/690 |
| 2006/0208999 | A1 * | 9/2006 | Lee | G09G 3/3426 345/102 |
| 2008/0136761 | A1 * | 6/2008 | Hong | G09G 3/2022 345/89 |
| 2008/0291190 | A1 * | 11/2008 | Kim | G09G 3/3648 345/211 |
| 2009/0040244 | A1 * | 2/2009 | Lee | G09G 3/3696 345/690 |
| 2009/0243982 | A1 * | 10/2009 | Lee | G09G 3/3406 345/88 |
| 2010/0295874 | A1 * | 11/2010 | Liu | G09G 3/3696 345/690 |
| 2011/0096101 | A1 * | 4/2011 | Lee | G09G 3/3406 345/690 |
| 2012/0154454 | A1 * | 6/2012 | Ohishi | G09G 3/342 345/690 |
| 2013/0147864 | A1 * | 6/2013 | Kim | G09G 3/3607 345/691 |

FOREIGN PATENT DOCUMENTS

| | | |
|---|---|---|
| KR | 10-2012-0038180 | 4/2012 |
| KR | 10-2013-0064428 | 6/2013 |
| KR | 10-2014-0137811 | 12/2014 |
| KR | 10-2015-0056940 | 5/2015 |

* cited by examiner

FIG. 7

| Maximum Grayscale Image Signal | Grayscale Level(gray) | Gamma Driving Voltage(AVDD) | | Light(L) | |
|---|---|---|---|---|---|
| Dm1 | B<G1<C | AVDD1 | V1a→V1b | L1 | 100% |
| Dm3 | A<G3<B | AVDD3 | V1a | L3 | 100%→50% |
| Dm4 | 0<G4<A | AVDD4 | V1a→V1d | L4 | 100%→25% |

FIG. 13

| Maximum Grayscale Image Signal | Grayscale Level(gray) | Gamma Driving Voltage(AVDD) | | Light(L) | |
|---|---|---|---|---|---|
| Dm1 | 0<G1<A | AVDD1 | V1a→V1d | L | 100%→25% |
| Dm3 | 0<G3<A | AVDD3 | V1a→V1d | | |
| Dm4 | 0<G4<A | AVDD4 | V1a→V1d | | |

FIG. 15

| Minimum Grayscale Image Signal | Grayscale Level(gray) | Gamma Driving Voltage(AVDD) | | Light(L) | |
|---|---|---|---|---|---|
| Dn1 | 0<G1<A | AVDD1 | V2a→V2b | L1 | 100%→25% |
| Dn3 | A<G3<B | AVDD3 | V2a | L3 | 100%→50% |
| Dn4 | B<G4<C | AVDD4 | V2a→V2d | L4 | 100% |

DISPLAY DEVICE

CROSS-REFERENCE TO RELATED APPLICATION

This application claims priority to and the benefit of Korean Patent Application No. 10-2015-0151343, under 35 U.S.C. § 119, filed on Oct. 29, 2015 in the Korean Intellectual Property Office (KIPO), the content of which is hereby incorporated by reference in its entirety.

BACKGROUND

1. Field of disclosure

One or more example embodiments of the inventive concept relate to a display device. More particularly, one or more example embodiments of the inventive concept relate to a display device that may be operated based on normally black and normally white operations.

2. Description of the Related Art

A display device includes a display panel for displaying an image, and gate and data driving circuits for driving the display panel. The display panel includes gate lines, data lines, and pixels. Each pixel may include a thin film transistor, a liquid crystal capacitor, and a storage capacitor. The data driving circuit applies data driving signals to the data lines, and the gate driving circuit applies gate driving signals to drive the gate lines.

In general, the display device performs a gamma correction operation to match a difference between a driving characteristic (e.g., linearity) and a human visual sensation characteristic (e.g., non-linearity) of a user. A gamma corrector that performs the gamma correction operation generates gamma reference voltages based on a gamma driving voltage according to characteristics of the display panel.

However, the gamma driving voltage is continuously applied to the data driving circuit at a constant DC voltage. As a result, the gamma reference voltages are generated to cover all grayscale (e.g., gray level) periods regardless of image signals. Accordingly, even when the data driving circuit requires only the gamma reference voltages with a relatively low level in accordance with the image signals, the gamma reference voltages with a relatively high level, which may be unnecessary, are applied to the data driving circuit.

The above information disclosed in this Background section is for enhancement of understanding of the background of the inventive concept, and therefore, it may contain information that does not constitute prior art.

SUMMARY

One or more example embodiments of the inventive concept provide a display device capable of controlling a gamma driving voltage in accordance with a grayscale level (e.g., a gray level) of an image signal and capable of controlling a brightness of light provided to a display panel.

According to an example embodiment of the inventive concept, a display device includes: a display panel including first group pixels connected to a first gate line to receive first data voltages, and second group pixels connected to the first gate line to receive second data voltages; a backlight source configured to provide light to the display panel; a signal controller configured to divide horizontal image signals into first group image signals and second group image signals, to extract a first maximum grayscale image signal from the first group image signals, and to extract a second maximum grayscale image signal from the second group image signals;

a power supply configured to generate first and second gamma driving voltages from a reference gamma driving voltage based on a grayscale level of the first maximum grayscale image signal and a grayscale level of the second maximum grayscale image signal; a first data driving circuit configured to apply the first data voltages generated based on the first gamma driving voltage and the first group image signals to the first group pixels; and a second data driving circuit configured to apply the second data voltages generated based on the second gamma driving voltage and the second group image signals to the second group pixels.

The signal controller may be configured to convert the first group image signals to first converted image signals based on the first maximum grayscale image signal, and to convert the second group image signals to second converted image signals based on the second maximum grayscale image signal.

The first data driving circuit may be configured to generate the first data voltages based on the first converted image signals, and the second data driving circuit may be configured to generate the second data voltages based on the second converted image signals.

The signal controller may be configured to generate the first gamma driving voltage that is lower than the reference gamma driving voltage in accordance with the grayscale level of the first maximum grayscale image signal, and to generate the second gamma driving voltage that is lower than the reference gamma driving voltage in accordance with the grayscale level of the second maximum grayscale image signal.

The backlight source may include first group light emitting diodes and second group light emitting diodes, the first group light emitting diodes being configured to provide a first light to the first group pixels in response to a first light control signal, and the second group light emitting diodes being configured to provide a second light to the second group pixels in response to a second light control signal.

The signal controller may be configured to compare the grayscale level of the first maximum grayscale image signal with a reference grayscale level, and to output the first light control signal to control a brightness of the first light according to the comparison.

The signal controller may be configured to generate the first light control signal to maintain the brightness of the first light at a maximum brightness and the power supply may be configured to generate the first gamma driving voltage that is lower than the reference gamma driving voltage, when the grayscale level of the first maximum grayscale image signal is greater than or equal to the reference grayscale level.

The signal controller may be configured to generate the first light control signal to lower the brightness of the first light from a maximum brightness and the power supply may be configured to generate the reference gamma driving voltage as the first gamma driving voltage, when the grayscale level of the first maximum grayscale image signal is less than or equal to the reference grayscale level.

The signal controller may be configured to generate the first light control signal to lower the brightness of the first light from a maximum brightness and the power supply may be configured to generate the first gamma driving voltage that is lower than the reference gamma driving voltage, when the grayscale level of the first maximum grayscale image signal is less than or equal to the reference grayscale level.

The signal controller may include: a memory configured to receive the horizontal image signals; a maximum grayscale extractor configured to extract the first maximum grayscale image signal and the second maximum grayscale image signal; an image signal converter configured to convert the first group image signals to first converted image signals based on the first maximum grayscale image signal, and to convert the second group image signals to second converted image signals based on the second maximum grayscale image signal; and a dimmer configured to control the backlight source in response to the first and second maximum grayscale image signals.

The image signal converter may include: a look-up table configured to store the first converted image signals and the second converted image signals; and a register configured to extract the first converted image signals corresponding to the grayscale level of the first maximum grayscale image signal from among the converted image signals stored in the look-up table, and to apply the extracted first converted image signals to the first data driving circuit.

The backlight source may include a plurality of light emitting diodes, and the light emitting diodes may be configured to provide the light to the first group pixels and the second group pixels in response to a light control signal.

The signal controller may be configured to generate a light control signal to lower a brightness of the light from a maximum brightness and the power supply may be configured to generate the first and second gamma driving voltages that are smaller than the reference gamma driving voltage, when the grayscale level of the first maximum grayscale image signal and the grayscale level of the second maximum grayscale image signal are less than or equal to a reference grayscale level.

The signal controller may be configured to store at least one horizontal image signal based on a maximum variation amount of a grayscale level that is variable during a horizontal blank period.

The signal controller may be configured to calculate a minimum gamma driving voltage that is utilized by each horizontal period based on the maximum variation amount of the grayscale level that is variable during the horizontal blank period, and the power supply may be configured to compare the minimum gamma driving voltage that is utilized by each horizontal period and the first gamma driving voltage, and to apply one of the minimum gamma driving voltage and the first gamma driving voltage to the first data driving circuit according to the comparison.

According to an embodiment of the inventive concept, a display device includes: a display panel including first group pixels connected to a first gate line to receive first data voltages, and second group pixels connected to the first gate line to receive second data voltages; a backlight source configured to provide light to the display panel; a signal controller configured to divide horizontal image signals into first group image signals and second group image signals, to extract a first minimum grayscale image signal from the first group image signals, and to extract a second minimum grayscale image signal from the second group image signals; a power supply configured to generate first and second gamma driving voltages from a reference gamma driving voltage based on a grayscale level of the first minimum grayscale image signal and a grayscale level of the second minimum grayscale image signal; a first data driving circuit configured to apply the first data voltages generated based on the first gamma driving voltage and the first group image signals to the first group pixels; and a second data driving circuit configured to apply the second data voltages generated based on the second gamma driving voltage and the second group image signals to the second group pixels.

The signal controller may be configured to convert the first group image signals to first converted image signals based on the first minimum grayscale image signal, and the first data driving circuit may be configured to generate the first data voltages based on the first converted image signals.

The backlight source may include first group light emitting diodes and second group light emitting diodes, the first group light emitting diodes may be configured to provide a first light to the first group pixels in response to a first light control signal, and the second group light emitting diodes may be configured to provide a second light to the second group pixels in response to a second light control signal.

The signal controller may be configured to generate the first light control signal to lower a brightness of the first light from a maximum brightness and the power supply may be configured to generate the reference gamma driving voltage as the first gamma driving voltage, when the grayscale level of the first minimum grayscale image signal is less than or equal to a reference grayscale level.

The signal controller may be configured to generate the first light control signal to maintain a brightness of the first light at a maximum brightness and the power supply may be configured to generate the first gamma driving voltage to lower the reference gamma driving voltage, when the grayscale level of the first minimum grayscale image signal is greater than or equal to a reference grayscale level.

According to one or more example embodiments, power consumption of the display device may be reduced.

BRIEF DESCRIPTION OF THE DRAWINGS

The above and other aspects and features of the present disclosure will become readily apparent by reference to the following detailed description when considered in conjunction with the accompanying drawings, wherein:

FIG. 7 is a table showing an operation of a signal controller and a backlight unit according to an exemplary embodiment of the present disclosure;

FIG. 13 is a table showing an operation of a signal controller and a backlight unit according to another exemplary embodiment of the present disclosure;

FIG. 15 is a table showing an operation of a signal controller and a backlight unit according to another exemplary embodiment of the present disclosure.

DETAILED DESCRIPTION

Figure 1:
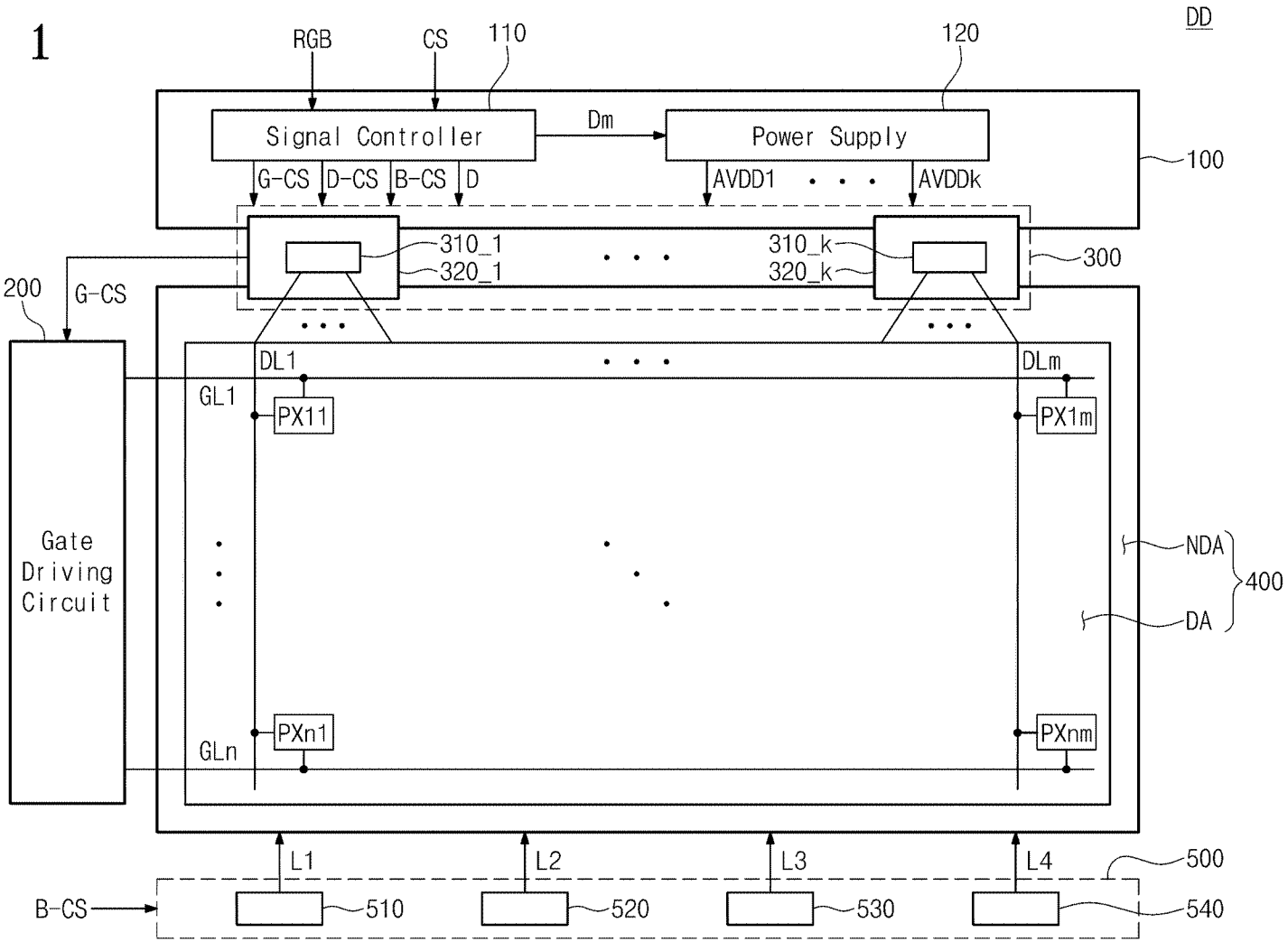
FIG. 1 is a block diagram showing a display device according to an exemplary embodiment of the present disclosure.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to one or more example embodiments, the display devices shown in FIGS. 1 to 13 may be operated in a normally black mode NB. The term "normally black mode NB" refers to a case where a grayscale level of an image signal corresponding to a data voltage becomes high as a level of the data voltage applied to a pixel increases.

FIG. 1 is a block diagram showing a display device DD according to an exemplary embodiment of the present disclosure.

Referring to FIG. 1, the display device DD includes a driving circuit board 100, a gate driving circuit 200, a data driving circuit 300, a display panel 400, and a backlight unit (e.g., a backlight source) 500.

The driving circuit board 100 includes a signal controller 110 to control an overall operation of the display device DD. The signal controller 110 receives a plurality of control signals CS and a plurality of image signals RGB from the outside of the display device DD.

The signal controller 110 outputs a plurality of driving signals in response to the control signal CS. The signal controller 110 generates a data control signal D-CS, a gate control signal G-CS, and a light control signal B-CS as the driving signals. For example, the gate control signal G-CS includes a vertical start signal, and the data control signal D-CS include a horizontal start signal, an output start signal, and a data enable signal.

The signal controller 110 applies the data control signal D-CS to the data driving circuit 300, and applies the gate control signal G-CS to the gate driving circuit 200. In addition, the signal controller 110 applies the light control signal B-CS to the backlight unit 500 to control a brightness of light provided to the display panel 400.

In addition, the signal controller 110 applies the gate control signal G-CS to the gate driving circuit 200 through one flexible printed circuit board from among a plurality of flexible printed circuit boards 320_1 to **320_*k* included in the data driving circuit 300, but the inventive concept is not limited thereto or thereby. That is, in another embodiment, the signal controller 110 may directly apply the gate control signal G-CS to the gate driving circuit 200**.

According to an exemplary embodiment, the signal controller 110 receives image signals RGB, and applies converted image signals D obtained by converting grayscale levels of the image signals RGB to the data driving circuit 300. The signal controller 110 applies the converted image signals to the data driving circuit 300 that are obtained by converting a data format to a data format appropriate to an interface between the signal controller 110 and the data driving circuit 300.

In addition, the signal controller 110 generates a maximum grayscale image signal for controlling a level of a plurality of gamma driving voltages AVDD1 to AVDDk, and applies the maximum grayscale image signal to the power supply 120. Here, the maximum grayscale image signal refers to an image signal (e.g., one image signal) having a maximum grayscale level (e.g., a highest grayscale level) from among the image signals RGB received by the signal controller 110 for a given frame. The power supply 120 generates a plurality of gamma driving voltages AVDD1 to AVDDk in response to the maximum grayscale image signal, and applies the gamma driving voltages AVDD1 to AVDDk to the data driving circuit 300. The operation of the signal controller 110 will be described in more detail with reference to FIG. 3.

The gate driving circuit 200 generates a plurality of gate signals GS1 to GSn in response to the gate control signal G-CS provided from the signal controller 110. The gate signals GS1 to GSn are sequentially applied to a plurality of pixels PX11 to PXnm through a plurality of gate lines GL1 to GLn in a unit of a row. As a result, the pixels PX11 to PXnm are operated in the unit of the row.

The data driving circuit 300 receives the converted image signals D and the data control signal D-CS from the signal controller 110. The data driving circuit 300 generates a plurality of data voltages corresponding to the converted image signals in response to the data control signal D-CS. The data driving circuit 300 applies the data voltages to the pixels PX11 to PXnm through a plurality of data lines DL1 to DLm.

In more detail, the data driving circuit 300 includes a plurality of source driving circuits 310_1 to **310_*k*. In an exemplary embodiment, "k" is an integer greater than 0 and less than m. The source driving circuits 310_1 to 310_*k* are mounted on the plurality of flexible printed circuit boards 320_1 to 320_*k*. The flexible printed circuit boards 320_1 to 320_*k* are connected to the driving circuit board 100** and a non-display area NDA that is adjacent to an upper portion of a display area DA.

The source driving circuits 310_1 to **310_*k* are mounted on the flexible printed circuit boards 320_1 to 320_*k* by a tape carrier package manner, but the inventive concept is not limited thereto or thereby. That is, in another embodiment, the source driving circuits 310_1 to 310_*k* may be mounted on the flexible printed circuit boards 320_1 to 320_*k*** by a chip-on-glass manner.

The display panel 400 includes the display area DA and the non-display area NDA adjacent to the display area DA. For example, the non-display area NDA may surround the display area DA.

The display panel 400 includes the pixels PX11 to PXnm arranged in the display area DA. In addition, the display panel 400 includes the gate lines GL1 to GLn, and the data lines DL1 to DLm insulated from the gate lines GL1 to GLn and crossing the gate lines GL1 to GLn.

The gate lines GL1 to GLn are connected to the gate driving circuit 200, and sequentially receive the gate signals GS1 to GSn. The data lines DL1 to DLm are connected to the data driving circuit 300, and receive the data voltages.

The pixels PX11 to PXnm are arranged at areas (e.g., crossing areas) defined by the gate lines GL1 to GLn and the data lines DL1 to DLm. Accordingly, the pixels PX11 to PXnm are arranged by n rows and m columns. Here, each of "n" and "m" is an integer number greater than 0.

Each of the pixels PX11 to PXnm is connected to a corresponding gate line of the gate lines GL1 to GLn and a corresponding data line of the data lines DL1 to DLm. The pixels PX11 to PXnm receive the data voltages through the data lines DL1 to DLm in response to the gate signals GS1 to GSn provided through the gate lines GL1 to GLn. As a result, the pixels PX11 to PXnm display grayscale levels corresponding to the data voltages.

The backlight unit 500 provides light to the display panel 400. According to an exemplary embodiment, the backlight unit 500 includes a plurality of group light emitting diodes. Each of the group light emitting diodes provides light to a corresponding area from among the entire area of the display panel 400. Hereinafter, for convenience, the backlight unit 500 including first, second, third, and fourth group light emitting diodes 510, 520, 530, and 540 will be described, but a number of the group light emitting diodes is not limited thereto.

The first to fourth group light emitting diodes 510 to 540 output first, second, third, and fourth lights L1, L2, L3, and L4 to the display panel 400 in response to the backlight control signal B-CS.

Figure 2:
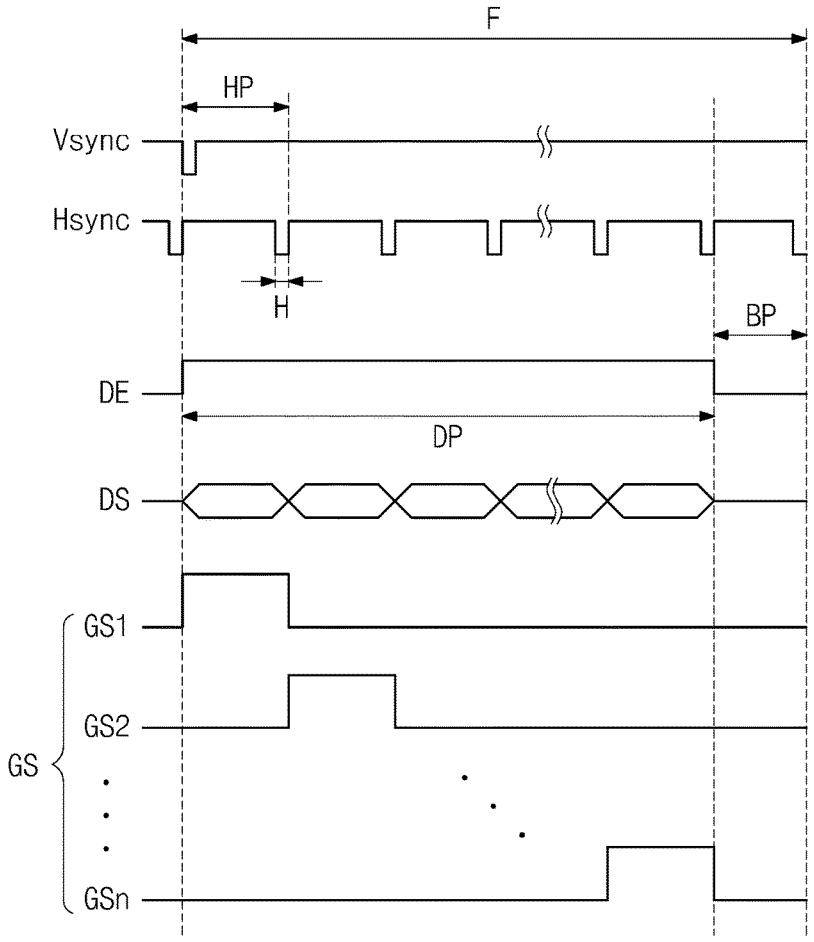
FIG. 2 is a timing diagram showing an operation of a gate driving circuit and a data driving circuit shown in FIG. 1.

FIG. 2 is a timing diagram showing an operation of the gate driving circuit 200 and the data driving circuit 300 shown in FIG. 1.

Referring to FIGS. 1 and 2, the signal controller 110 outputs the driving signals. For example, the signal controller 110 applies a vertical start signal Vsync to the gate driving circuit 200 during a frame F. Here, the frame F refers to a period (e.g., a unit frame period), during which one image is displayed.

The signal controller 110 applies a signal (e.g., a horizontal synchronization signal Hsync) during horizontal periods HP to the data driving circuit 300 as a row distinction signal. In addition, the signal controller 110 applies a data enable signal DE, which may be maintained or substantially maintained at a high level during a period in which data are output, to the data driving circuit 300 to indicate a data voltage input period.

The vertical synchronization signal Vsync is included in the gate control signal G-CS. The horizontal synchronization signal Hsync and the data enable signal DE are included in the data control signal D-CS. The gate control signal G-CS may further include a clock signal and a clock bar signal to generate the gate signals GS1 to GSn at, for example, the high level.

The data voltages DS output from the data driving circuit 300 include positive data voltages having a positive value with respect to a common voltage, and/or negative data voltages having a negative value with respect to the common voltage. During the horizontal periods HP, a part of the data voltages DS applied to the data lines DL1 to DLm has a positive polarity, and another part of the data voltages DS applied to the data lines DL1 to DLm has a negative polarity.

Meanwhile, the gate signals GS1 to GSn are sequentially output to correspond to the horizontal periods HP. The data voltages DS are applied to the pixels connected to corresponding gate lines from among the gate lines GL1 to GLn during each of the horizontal periods HP.

In addition, the display panel 400 includes a display period DP during which an image is displayed based on the corresponding frame, and a blank period BP during which no image is displayed. The display period DP for displaying the image corresponds to a period during which the data voltages DS are applied to the data lines DL1 to DLm, and the data enable signal DE has a high level during the display period DP. The blank period BP corresponds to a period during which the data voltages DS are not applied to the data lines DL1 to DLm, and the data enable signal DE has a low level during the blank period BP.

Figure 3:
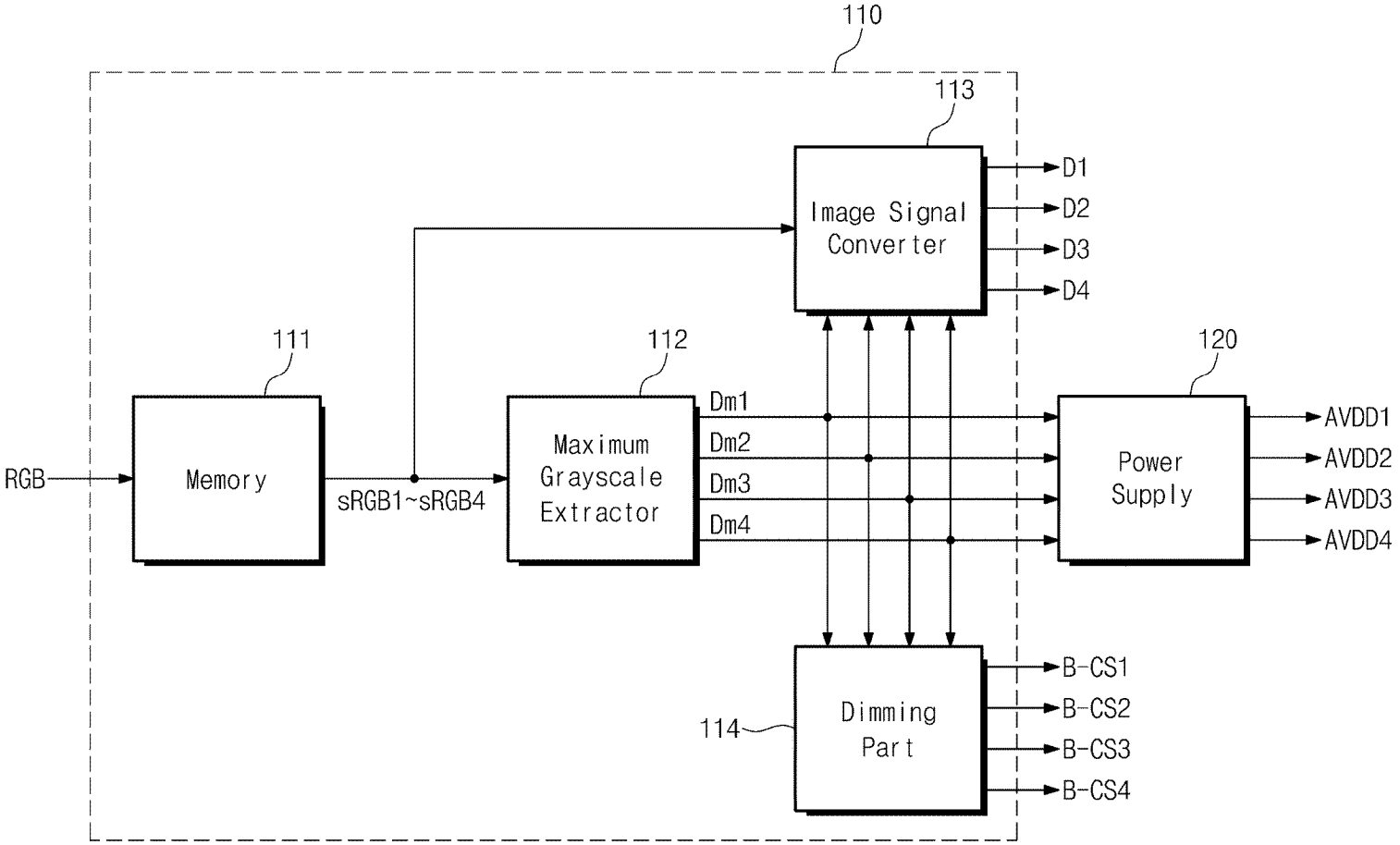
FIG. 3 is a block diagram showing a signal controller and a power supply shown in FIG. 1 according to an exemplary embodiment of the present disclosure.
Figure 4:
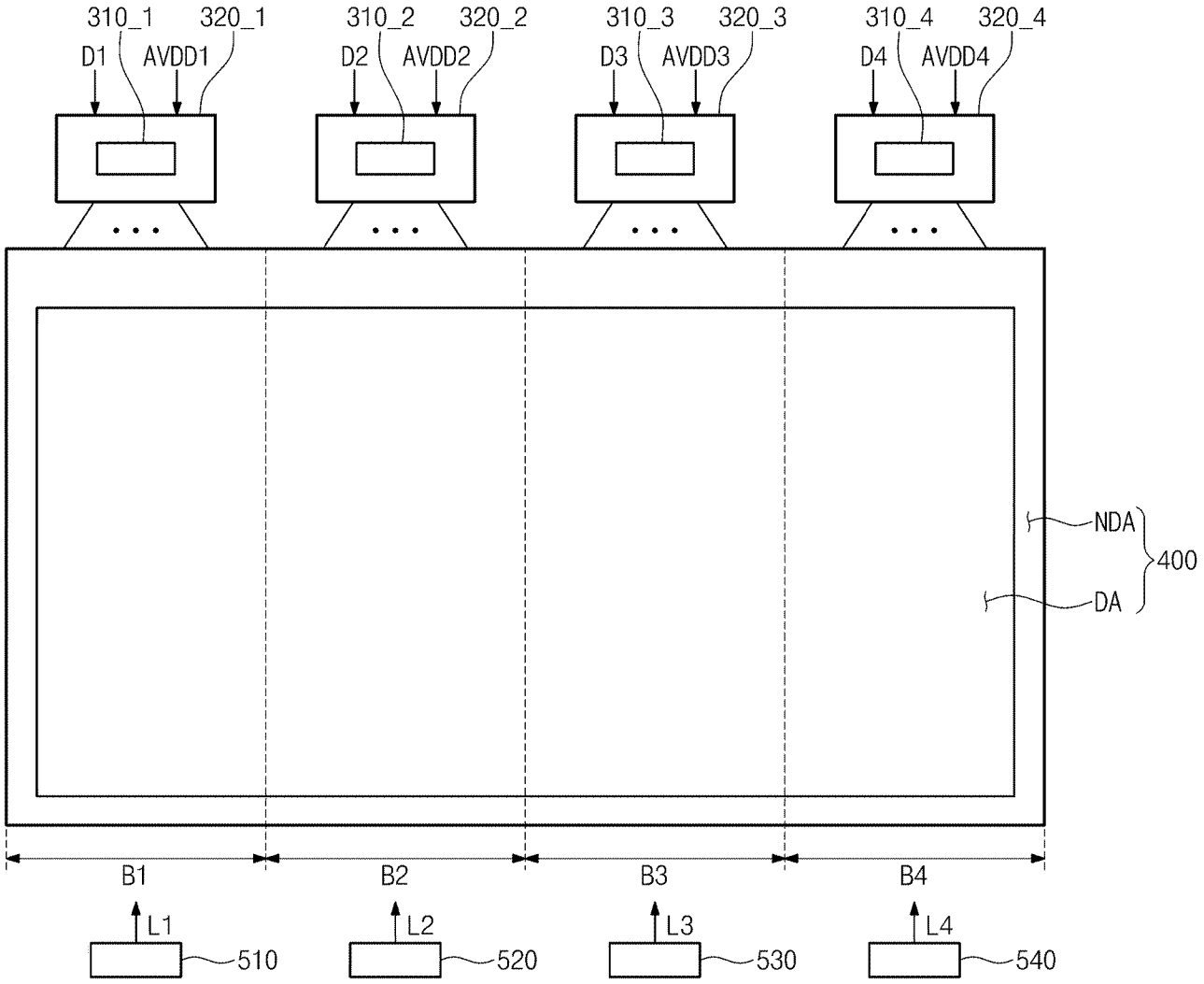
FIG. 4 is a block diagram showing a converted image signal and an emission of light, which are provided to a display panel according to an exemplary embodiment of the present disclosure.
Figure 5:
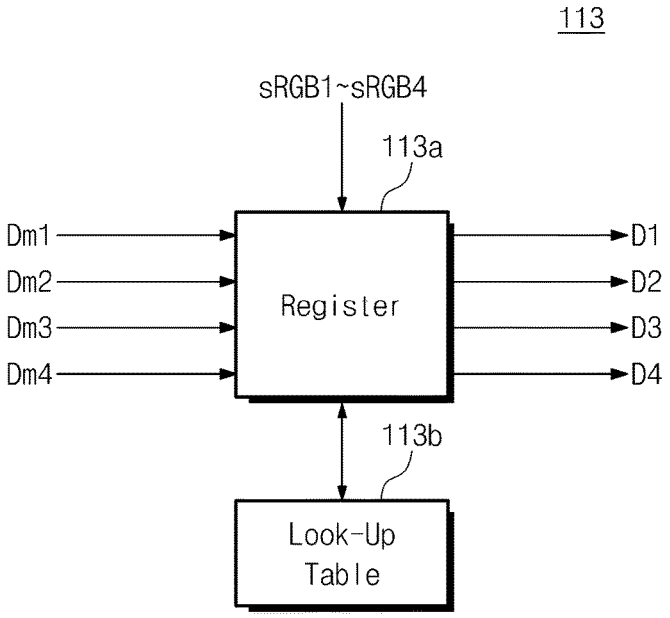
FIG. 5 is a block diagram showing an image signal converter shown in FIG. 3.
Figure 6:
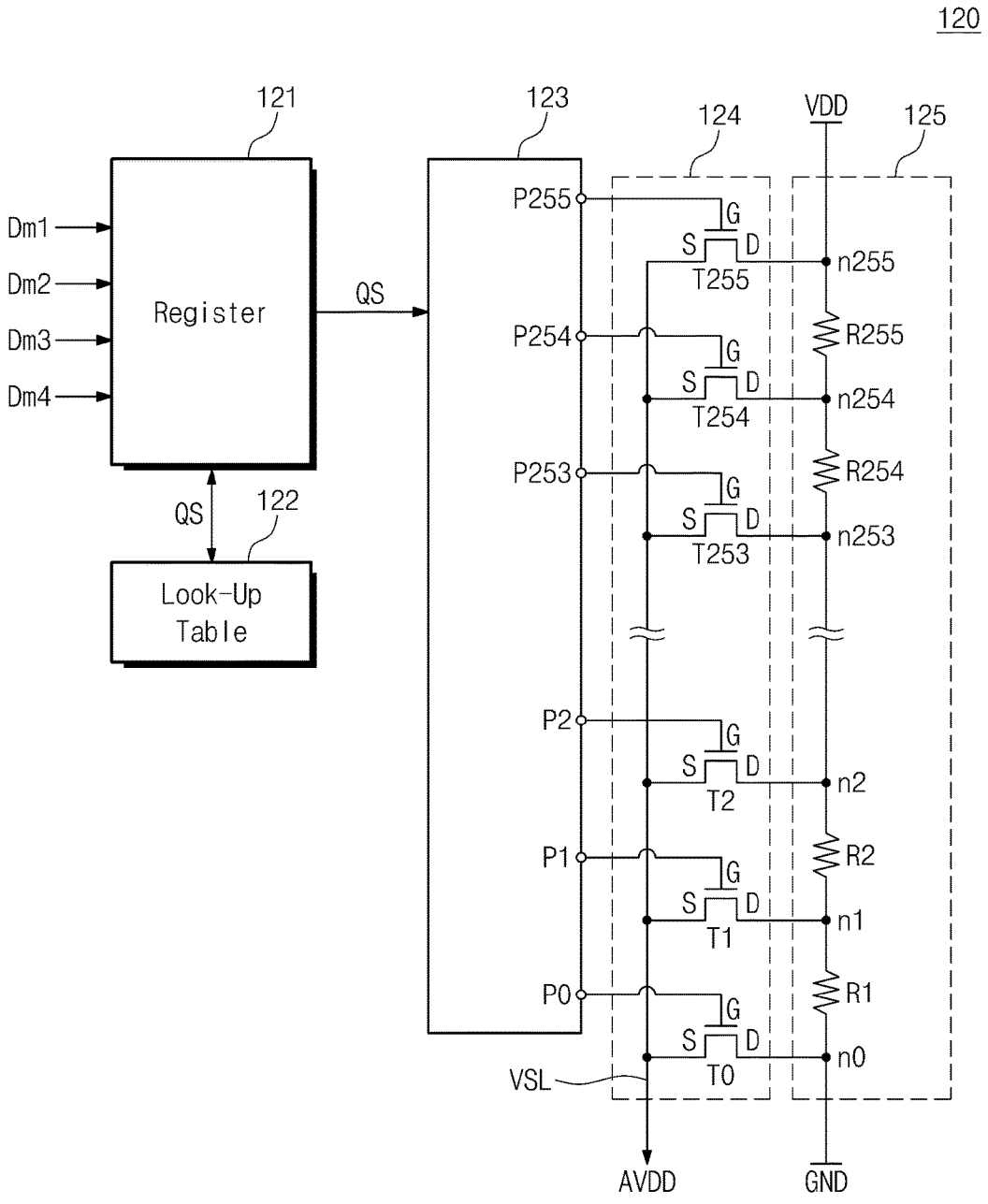
FIG. 6 is a block diagram showing the power supply shown in FIG. 3.

FIG. 3 is a block diagram showing the signal controller 110 and the power supply 120 shown in FIG. 1 according to an exemplary embodiment of the present disclosure. FIG. 4 is a block diagram showing a converted image signal and an emission of light, which are provided to the display panel 400 according to an exemplary embodiment of the present disclosure, FIG. 5 is a block diagram showing an image signal converter 113 shown in FIG. 3, and FIG. 6 is a block diagram showing the power supply 120 shown in FIG. 3.

Referring to FIGS. 3 and 4, the signal controller 110 includes a memory 111, a maximum grayscale extractor 112, an image signal converter 113, and a dimming part (e.g., a dimmer) 114.

The memory 111 receives the image signals RGB every frame. According to an exemplary embodiment, the memory 111 stores the image signals RGB for each horizontal period in accordance with the frames. That is, the memory 111 stores the image signals corresponding to the data voltages that is to be output for the corresponding horizontal period from among the image signals RGB. Hereinafter, the image signals stored in the memory 111 based on the horizontal period will be described as horizontal image signals.

In addition, the memory 111 classifies the horizontal image signals according to each horizontal period into a plurality of group image signals.

According to an exemplary embodiment, the memory 111 classifies the horizontal image signals into the group image signals based on the number of the source driving circuits 310_1 to **310_*k* included in the data driving circuit 300**.

As shown in FIG. 4, in the case where the data driving circuit 300 includes first to fourth source driving circuits 310_1 to 310_4, the memory 111 classifies the horizontal image signals according to each horizontal period into four group image signals.

According to an exemplary embodiment, the memory 111 classifies the horizontal image signals into the group image signals based on the number of group light emitting diodes included in the backlight unit 500. As shown in FIG. 4, the display panel 400 includes first to fourth light areas 31 to 34 receiving first to fourth lights L1 to L4 output from the first to fourth group light emitting diodes 510 to 540, respectively.

Hereinafter, for convenience, the memory 111 that classifies the horizontal image signals into first to fourth group image signals sRGB1 to sRGB4 will be described. Accordingly, first to fourth group pixels are respectively connected to the first to fourth source driving circuits 310_1 to **310_*k*** in each horizontal period.

The memory 111 applies the first to fourth group image signals sRGB1 to sRGB4 to the maximum grayscale extractor 112 and the image signal converter 113.

The maximum grayscale extractor 112 receives the group image signals from the memory 111, and extracts a maximum grayscale image signal having a maximum grayscale level (e.g., a highest grayscale level) from the group image signals.

In more detail, the maximum grayscale extractor 112 receives the first to fourth group image signals sRGB1 to sRGB4. The maximum grayscale extractor 112 extracts a first maximum grayscale image signal Dm1 having the maximum grayscale level (e.g., the highest grayscale level) from among the first group image signals sRGB1. The maximum grayscale extractor 112 extracts a second maximum grayscale image signal Dm2 having the maximum grayscale level (e.g., the highest grayscale level) from among the second group image signals sRGB2. The maximum grayscale extractor 112 extracts a third maximum grayscale image signal Dm3 having the maximum grayscale level (e.g., the highest grayscale level) from among the third group image signals sRGB3. The maximum grayscale extractor 112 extracts a fourth maximum grayscale image signal Dm4 having the maximum grayscale level (e.g., the highest grayscale level) from among the fourth group image signals sRGB4.

The maximum grayscale extractor 112 applies the first to fourth maximum grayscale image signals Dm1 to Dm4 extracted from the first to fourth group image signals sRGB1 to sRGB4 to the image signal converter 113, the dimming part 114, and the power supply 120.

The image signal converter 113 receives the first to fourth group image signals sRGB1 to sRGB4 from the memory 111, and receives the first to fourth maximum grayscale image signals Dm1 to Dm4 from the maximum grayscale extractor 112.

The image signal converter 113 converts the first to fourth group image signals sRGB1 to sRGB4 to first to fourth converted image signals D1 to D4 in response to the first to fourth maximum grayscale image signals Dm1 to Dm4.

For example, the image signal converter 113 converts the grayscale level of the first maximum grayscale image signal Dm1 having the maximum grayscale level (e.g., the highest grayscale level) from among the first group image signals sRGB1 toward a white grayscale level based on a reference gamma curve, to allow the first maximum grayscale image signal Dm1 to be expressed in the data driving circuit 300. In addition, the image signal converter 113 converts the grayscale level of first group image signals sRGB1, except for the first maximum grayscale image signal Dm1, toward the white grayscale level based on the reference gamma curve, to allow the first group image signals sRGB1, except for the first maximum grayscale image signal Dm1, to be expressed in the data driving circuit 300.

That is, the image signal converter 113 generates the first converted image signals D1 obtained by controlling the first group image signals sRGB1 toward the white grayscale level based on the reference gamma curve. The image signal converter 113 converts the second to fourth group image signals sRGB2 to sRGB4 to the second to fourth converted image signals D2 to D4 using the above-described method. Accordingly, detailed descriptions of the conversion of the second to fourth group image signals sRGB2 to sRGB4 to the second to fourth converted image signals D2 to D4 will be omitted.

Referring to FIG. 5, the image signal converter 113 includes a register 113*a* and a look-up table 113*b*.

The register 113*a* may extract (e.g., read out) the first to fourth converted image signals D1 to D4 stored in the look-up table 113*b* in response to the first to fourth group image signals sRGB1 to sRGB4. The register 113*a* applies the extracted (e.g., read-out) first to fourth converted image signals D1 to D4 to the first to fourth flexible printed circuit boards 320_1 to 320_*k*, respectively, as shown in FIG. 4.

The look-up table 113*b* stores the converted image signals obtained by converting the grayscale level of the corresponding group image signal toward the white grayscale level in accordance with the gamma curve. The look-up table 113*b* stores (e.g., previously stores) converted image signals respectively corresponding to 0 to 255 grayscale levels.

Therefore, the register 113*a* may extract (e.g., read out) the converted image signal stored in the look-up table 113*b* based on the grayscale level of the corresponding group image signal.

The dimming part 114 receives the first to fourth maximum grayscale image signals Dm1 to Dm4 from the maximum grayscale extractor 112. The dimming part 114 controls a brightness of light generated by the backlight unit 500 in response to the first to fourth maximum grayscale image signals Dm1 to Dm4.

According to an exemplary embodiment, the dimming part 114 performs a local dimming individually on the first to fourth group light emitting diodes 510 to 540.

For example, the dimming part 114 performs the local dimming on each of the first to fourth group light emitting diodes 510 to 540, and thus, the first to fourth lights L1 to L4 emitted from the first to fourth group light emitting diodes 510 to 540 may have different brightnesses from each other. As a result, the lights having different brightnesses from each other may be provided to the light areas B1 to B4 of the display panel 400, respectively.

In more detail, the dimming part 114 generates first to fourth light control signals B-CS1 to B-CS4 in response to the first to fourth maximum grayscale image signals Dm1 to Dm4. The first group light emitting diodes 510 emit the first light L1 in response to the first light control signal B-CS1. The second group light emitting diodes 520 emit the second light L2 in response to the second light control signal B-CS2. The third group light emitting diodes 530 emit the third light L3 in response to the third light control signal B-CS3. The fourth group light emitting diodes 540 emit the fourth light L4 in response to the fourth light control signal B-CS4.

The power supply 120 receives the first to fourth maximum grayscale image signals Dm1 to Dm4 from the maximum grayscale extractor 112. The power supply 120 generates first to fourth gamma driving voltages AVDD1 to AVDD4 from a reference gamma driving voltage in response to the first to fourth maximum grayscale image signals Dm1 to Dm4. Here, the reference gamma driving voltage may be used to express the maximum grayscale level (e.g., the 255 grayscale level) according to a normal gamma curve.

According to an exemplary embodiment, the power supply 120 generates the first to fourth gamma driving voltages AVDD1 to AVDD4, which have levels that are the same or substantially the same as each other or have at least one different level, in response to the first to fourth maximum grayscale image signals Dm1 to Dm4.

Referring to FIG. 6, the power supply 120 includes a register 121, a look-up table 122, a decoder 123, a switch array 124, and a resistor string 125.

The register 121 may extract (e.g., read out) a switching control signal QS stored in the look-up table 122 in response to the maximum grayscale image signal. The register 121 applies the extracted (e.g., read-out) switching control signal QS to the decoder 123.

The look-up table 122 stores (e.g., previously stores) a plurality of switching control signals QS corresponding to each of the grayscale levels of the maximum grayscale image signal. That is, the look-up table 122 stores (e.g., previously stores) the switching control signals QS respectively corresponding to 0 to 255 grayscale levels. In an embodiment, the switching control signals QS may be realized as a digital signal of 8-bits.

The decoder 123 decodes the switching control signal QS provided from the register 121, and applies the decoded switching control signal QS to a plurality of output pins P0 to P255. The decoder 123 includes, for example, 256 output pins P0 to P255 corresponding to a number of the switching control signals QS of 8-bits.

The switch array 124 includes a plurality of switches T0 to T255. Gate terminals G of the switches T0 to T255 are electrically connected to the output pins P0 to P255, respectively. The gate terminals G of the switches T0 to T255 receive the decoded switching control signals through the output pins P0 to P255. Drain terminals D of the switches T0 to T255 are electrically connected to voltage-division voltage nodes n0 to n255, respectively, and resistors R1 to R255 included in the resistor string 125 are connected between corresponding ones of the voltage-division voltage nodes n0 to n255. Source terminals S of the switches T0 to T255 are commonly connected to a gamma supply line VSL.

The gamma driving voltage AVDD according to each maximum grayscale image signal may be set to one gamma driving voltage AVDD of the voltage-division voltages. That is, since one switch of the switches T0 to T255 is turned on in response to the decoded switching control signal, one voltage-division voltage of the voltage-division voltages may be selected as the gamma driving voltage AVDD.

As a result, the gamma driving voltage AVDD may decrease from the reference gamma driving voltage VDD of the maximum grayscale image signal to at or near an analog gamma compensation voltage.

The resistor string 125 includes the resistors R1 to R255 connected to each other in series between the reference gamma driving voltage VDD and a ground voltage GND. The resistor string 125 generates the voltage-division voltages having different levels from each other through the voltage-division voltage nodes n0 to n255 arranged between the resistors R1 to R255.

Figure 8:
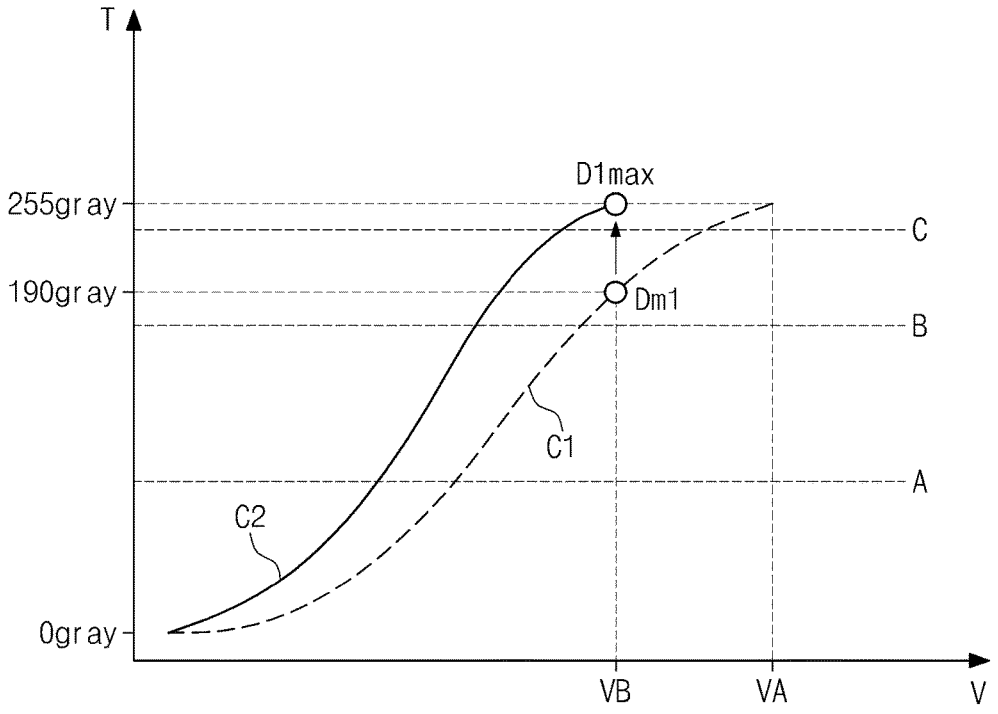
FIG. 8 is a graph showing a first maximum grayscale image signal shown in FIG. 7.
Figure 9:
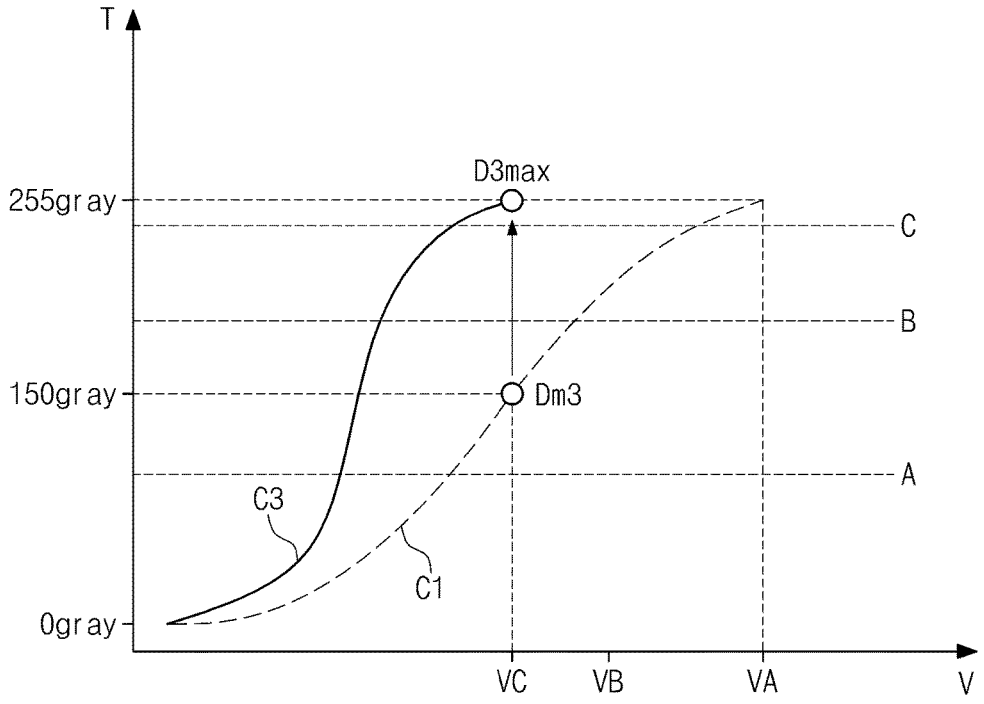
FIG. 9 is a graph showing a third maximum grayscale image signal shown in FIG. 7.
Figure 10:
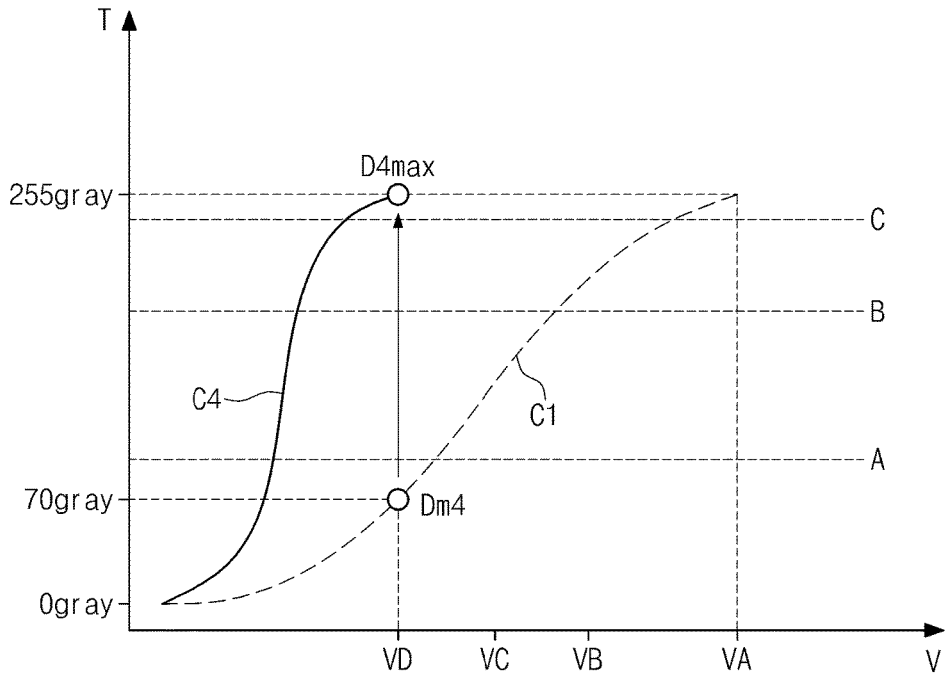
FIG. 10 is a graph showing a fourth maximum grayscale image signal shown in FIG. 7.

FIG. 7 is a table showing an operation of a signal controller and a backlight unit (e.g., a backlight source) according to an exemplary embodiment of the present disclosure, FIG. 8 is a graph showing a first maximum grayscale image signal shown in FIG. 7, FIG. 9 is a graph showing a third maximum grayscale image signal shown in FIG. 7, and FIG. 10 is a graph showing a fourth maximum grayscale image signal shown in FIG. 7.

The table shown in FIG. 7 shows that the gamma driving voltage AVDD and the light L are controlled depending on the grayscale level of the maximum grayscale image signal. In the graphs shown in FIGS. 8 to 10, horizontal axes indicate the gamma compensation voltage V corresponding to each grayscale level, and vertical axes indicate the grayscale level T.

Hereinafter, the first, the third, and the fourth maximum grayscale image signals Dm1, Dm3, and Dm4 from among the first to fourth maximum grayscale image signals Dm1 to Dm4 shown in FIG. 3 will be described in more detail.

According to an exemplary embodiment, the gamma driving voltage AVDD and the light L may be controlled depending on the grayscale level of the maximum grayscale image signal.

Referring to FIGS. 7 and 8, the level of the gamma driving voltage AVDD decreases based on the first maximum grayscale image signal Dm1, and the brightness level of the light L is maintained or substantially maintained at a maximum level.

In more detail, the first maximum grayscale image signal Dm1 may have a first grayscale level G1. In this case, the first grayscale level G1 corresponds to a grayscale level between a first reference grayscale level C and a second reference grayscale level B. For example, the first reference grayscale level C is at about 250 grayscale level, and the second reference grayscale level B is at about 180 grayscale level.

According to an exemplary embodiment, in the case where the first maximum grayscale image signal Dm1 has the grayscale level between the first reference grayscale level C and the second reference grayscale level B, the power supply 120 outputs the first gamma driving voltage AVDD1 obtained by controlling the reference gamma driving voltage. That is, the power supply 120 outputs the first gamma driving voltage AVDD1 obtained by lowering a level of a first driving voltage V1*a*, which is the reference gamma driving voltage, to a level of a second driving voltage V1*b*.

As a result, the data driving circuit 300 (e.g., refer to FIG. 1) generates second gamma compensation voltages VB, which are applied to the first group pixels, based the first gamma driving voltage AVDD1 and the first converted image signals D1 in accordance with a second gamma curve C2. A first gamma curve C1 may be a gamma curve of normal gamma compensation voltages VA according to normal image signals.

In this case, as shown in FIG. 8, a voltage level of the second gamma compensation voltages VB generated based on the first gamma driving voltage AVDD1 and the first converted image signals D1 may be lower than a voltage level of the first gamma compensation voltages VA generated based on the reference gamma driving voltage and the reference image signals. As a result, power consumption used to drive the display device DD may be reduced more than when the gamma compensation voltages are generated based on the reference gamma driving voltage.

As described above, the reference gamma driving voltage may be the voltage (e.g., a DC voltage) used to generate the maximum grayscale level of the normal image signal regardless of the maximum grayscale image signal. The reference image signals may be, but not limited to, image signals corresponding to a plurality of group images in which the grayscale levels thereof are not changed.

The dimming part 114 outputs the first light control signal B-CS1 to maintain or substantially maintain the brightness of the first light L1 at a first level (e.g., 100%), because the first maximum grayscale image signal Dm1 has the grayscale level between the first reference grayscale level C and the second reference grayscale level B. The first level (e.g., 100%) refers to the light having a maximum brightness. In the case where the brightness of the first light L1 is maintained or substantially maintained at the first level (e.g., 100%), the first group light emitting diodes 510 may be operated at a maximum power.

As described above, in the case where the grayscale level of the maximum grayscale image signal has a high grayscale level corresponding to between the first reference grayscale level C and the second reference grayscale level B, the brightness of the light is maintained or substantially maintained at the maximum brightness in accordance with a human visual sensation characteristic of a user. In addition, the level of the gamma driving voltage AVDD applied to the data driving circuit 300 may be changed to be lower than that of the reference gamma driving voltage.

Referring to FIGS. 7 and 9, the level of the gamma driving voltage AVDD is maintained or substantially maintained at the reference gamma driving voltage based on the third maximum grayscale image signal Dm3, and the brightness of the light is lowered.

In more detail, the third maximum grayscale image signal Dm3 has a third grayscale level G3. In this case, the third grayscale level G3 has a grayscale level between the second reference grayscale level B and a third reference grayscale level A. In an exemplary embodiment, the second reference grayscale level B is at about 190 grayscale level, and the third reference grayscale level A is at about 128 grayscale level.

According to an exemplary embodiment, in the case where the third maximum grayscale image signal Dm3 has the grayscale level between the second reference grayscale level B and the third reference grayscale level A, the power supply 120 outputs the reference gamma driving voltage as the third gamma driving voltage AVDD3. That is, the power supply 120 outputs the first driving voltage V1*a*, which is the reference gamma driving voltage, as the third gamma driving voltage AVDD3.

As a result, the data driving circuit 300 (e.g., refer to FIG. 1) generates third gamma compensation voltages VC, which are applied to the third group pixels, based on the third gamma driving voltage AVDD3 and the third converted image signals D3 in accordance with a third gamma curve C3.

The dimming part 114 outputs the third light control signal B-CS3 to lower the brightness of the third light L3 to a second level (e.g., 50%), because the third maximum grayscale image signal Dm3 has the grayscale level between the second reference grayscale level B and the third reference grayscale level A. Because the brightness of the third light L3 is lowered to the second level (e.g., 50%) from the first level (e.g., 100%), the power consumption in the third group light emitting diodes 530 may be reduced.

As described above, in the case where the grayscale level of the maximum grayscale image signal has an intermediate grayscale level corresponding to between the second reference grayscale level B and the third reference grayscale level A, the brightness level of the light may be controlled to be lowered. In addition, the level of the gamma driving voltage AVDD applied to the data driving circuit 300 is maintained or substantially maintained at the reference gamma driving voltage. In more detail, because the brightness level of the light is controlled to be lowered, the level of the gamma compensation voltages may be increased to compensate for the lowered brightness level of the light. That is, because the level of the gamma compensation voltages increases to compensate for the lower brightness level of the light, it may be undesirable to control the level of the gamma driving voltage AVDD used to generate the gamma compensation voltages.

Referring to FIGS. 7 and 10, the level of the gamma driving voltage AVDD is lowered based on the fourth maximum grayscale image signal Dm4, and therefore, the brightness of the light is lowered.

In more detail, the fourth maximum grayscale image signal Dm4 has a third grayscale level G4. In this case, the fourth grayscale level G4 has a grayscale level between the third reference grayscale level A and a minimum grayscale level (e.g., a 0 grayscale level).

According to an exemplary embodiment, in the case where the fourth maximum grayscale image signal Dm4 has the grayscale level between the third reference grayscale level A and the minimum grayscale level, the power supply 120 outputs the fourth gamma driving voltage AVDD4 obtained by controlling the reference gamma driving voltage. That is, the power supply 120 outputs the fourth gamma driving voltage AVDD4 obtained by lowering the level of the first driving voltage V1*a*, which is the reference gamma driving voltage, to a level of a fourth driving voltage V1*d*.

As a result, the data driving circuit 300 (e.g., refer to FIG. 1) generates fourth gamma compensation voltages VD, which are applied to the fourth group pixels, based on the fourth gamma driving voltage AVDD4 and the fourth converted image signals D4 in accordance with a fourth gamma curve C4.

In this case, as shown in FIG. 10, a voltage level of the fourth gamma compensation voltages VD generated based on the fourth gamma driving voltage AVDD4 and the fourth converted image signals D4 may be lower than the voltage level of the first gamma compensation voltages VA generated based on the reference gamma driving voltage and the reference image signals. As a result, the power consumption used to drive the display device DD may be reduced more than when the gamma compensation voltages are generated based on the reference gamma driving voltage.

The dimming part 114 outputs the fourth light control signal B-CS4 to lower the brightness of the fourth light L4 to a third level (e.g., 25%), because the fourth maximum grayscale image signal Dm4 has the grayscale level between the third reference grayscale level A and the minimum grayscale level. Because the brightness of the fourth light L4 is lowered to the third level (e.g., 25%) from the first level (e.g., 100%), the power consumption in the fourth group light emitting diodes 540 may be reduced.

As described above, in the case where the grayscale level of the maximum grayscale image signal has a low grayscale level corresponding to between the third reference grayscale level A and the minimum grayscale level, the gamma driving voltage AVDD and the brightness level of the light may be controlled to be lowered.

In more detail, in the case where the image is displayed at the intermediate or high grayscale level, the brightness level of the light L is lowered, and it may be undesirable to change the level of the gamma driving voltage AVDD used to compensate for the light L. However, in the case where the image is displayed at the low grayscale level, variation (e.g., significant variation) in visual characteristics may not be recognized by the user, even though the brightness level of the light L and the level of the gamma driving voltage AVDD are lowered.

According to an exemplary embodiment, the gamma driving voltage may be controlled every horizontal period, and the brightness of the light may be controlled every frame.

Figure 11:
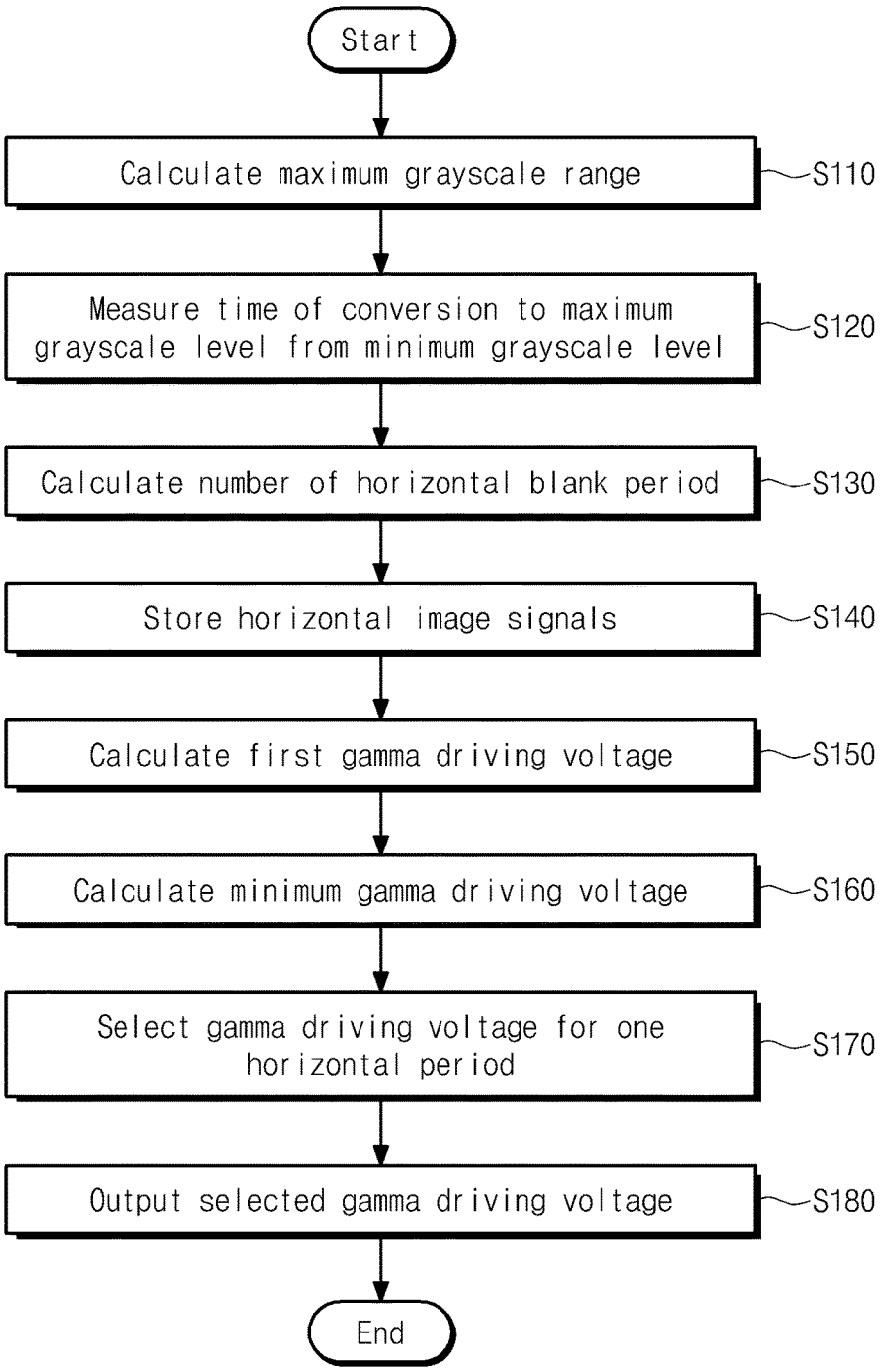
FIG. 11 is a flowchart showing an operation of the signal controller and the power supply shown in FIG. 3 to output a final gamma driving voltage.

FIG. 11 is a flowchart showing an operation of the signal controller 110 and the power supply 120 shown in FIG. 3 to output a final gamma driving voltage.

Referring to FIGS. 3 and 11, the signal controller 110 calculates a maximum grayscale range that is variable between the maximum grayscale image signals during a horizontal blank period H (e.g., refer to FIG. 2) (S110). Here, the horizontal blank period H corresponds to a period obtained by subtracting a period in which the data voltage is output from the horizontal period HP shown in FIG. 2.

The signal controller 110 measures a time during which the minimum grayscale level is converted to the maximum grayscale level (S120).

The signal controller 110 calculates the number of the horizontal blank periods H, which is used to convert the minimum grayscale level to the maximum grayscale level (S130).

The signal controller 110 stores the horizontal image signals based on the calculated number of the horizontal blank periods H (S140). For example, in the case where three horizontal blank periods H are used to convert the minimum grayscale level to the maximum grayscale level, the signal controller 110 stores three horizontal image signals.

The signal controller 110 calculates the first gamma driving voltage V1 corresponding to the maximum grayscale image signal from among the group image signals corresponding to one horizontal period (S150).

The signal controller 110 calculates a minimum gamma driving voltage V2 used by the one horizontal period based on the time used to convert the minimum grayscale level to the maximum grayscale level (S160).

The signal controller 110 compares the first gamma driving voltage V1 and the second gamma driving voltage V2, and selects one of the first gamma driving voltage V1 and the second gamma driving voltage V2 during the one horizontal period according to the compared result (S170).

The power supply 120 outputs the selected gamma driving voltage (S180).

Figure 12:
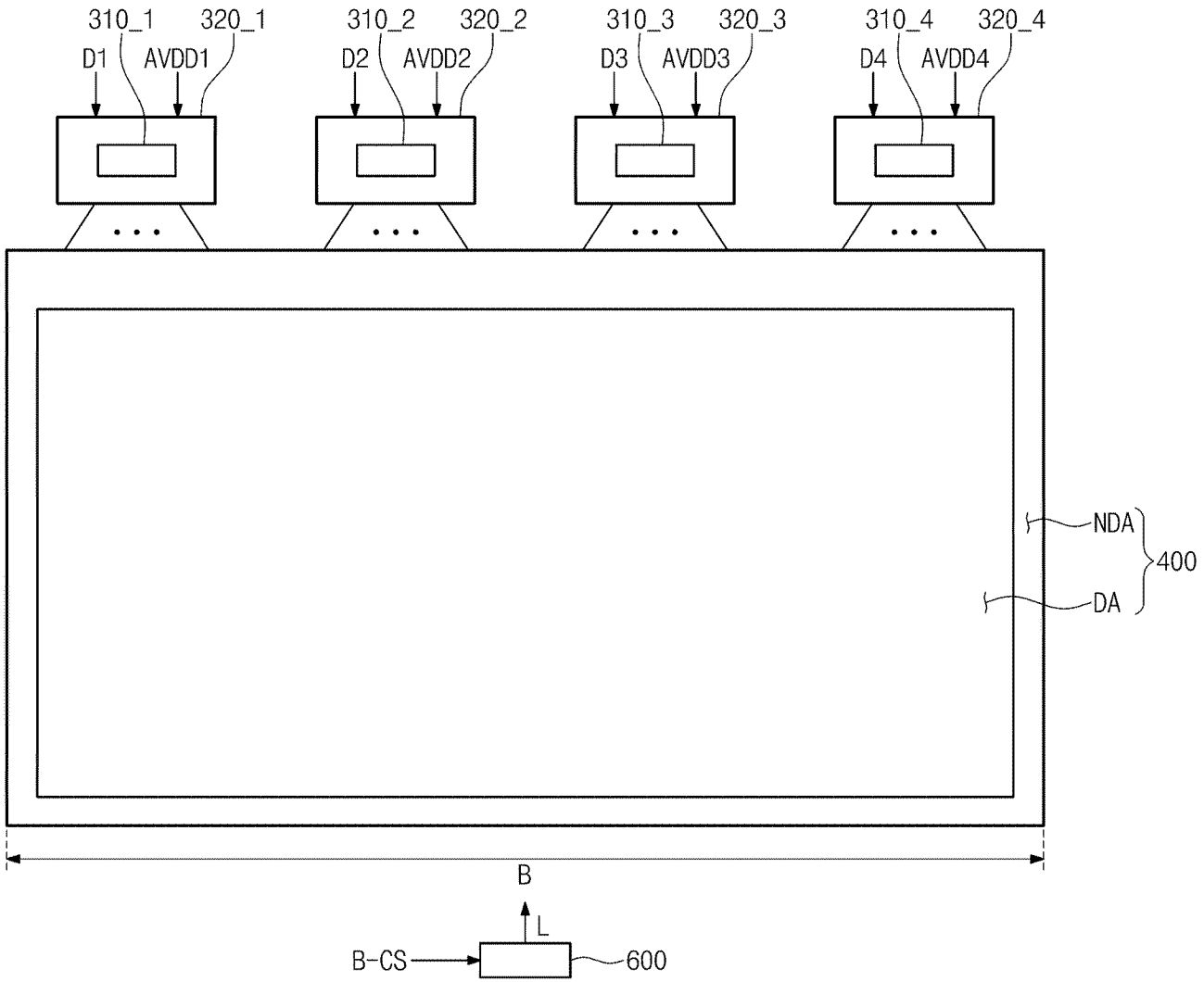
FIG. 12 is block diagram showing a converted image signal and an emission of light, which are provided to a display panel according to another exemplary embodiment of the present disclosure.

FIG. 12 is block diagram showing a converted image signal and an emission of light, which are provided to a display panel according to another exemplary embodiment of the present disclosure, and FIG. 13 is a table showing an operation of a signal controller and a backlight unit (e.g., a backlight source) according to another exemplary embodiment of the present disclosure.

Referring to FIGS. 12 and 13, a data driving circuit 300 and a display panel 400 shown in FIG. 12 may have the same or substantially the same structure as those of the data driving circuit 300 and the display panel 400 shown in FIG. 4, and thus, detailed descriptions of the data driving circuit 300 and the display panel 400 will not be repeated.

A backlight unit (e.g., a backlight source) 600 shown in FIG. 12 is realized as a single group of light emitting diodes different from those of the backlight unit 500 shown in FIG. 4.

In more detail, the backlight unit 600 may provide the light at a constant or substantially constant brightness to the entire area of the display panel 400. That is, the backlight unit 600 provides the light having the constant or substantially constant brightness using a global dimming, rather than the local dimming of the backlight unit 500 shown in FIG. 4.

The dimming part 114 (e.g., refer to FIG. 3) generates a light control signal B-CS, and applies the light control signal B-CS to the backlight unit 600 to control an operation of the backlight unit 600.

Referring to FIG. 13, the dimming part 114 generates the light control signal B-CS to lower the brightness level of the light L in the case where the grayscale levels G1, G3, and G4 of the first, third, and fourth maximum grayscale image signals Dm1, Dm3, and Dm4 correspond to the low grayscale level. In this case, the power supply 120 (e.g., refer to FIG. 3) outputs the fourth gamma driving voltage AVDD4 obtained by lowering the level of the first driving voltage V1*a* to the level of the fourth driving voltage V1*d*. The low grayscale level may have the grayscale level between the minimum grayscale level (e.g., the 0 grayscale level) and the third reference grayscale level A.

Figure 14:
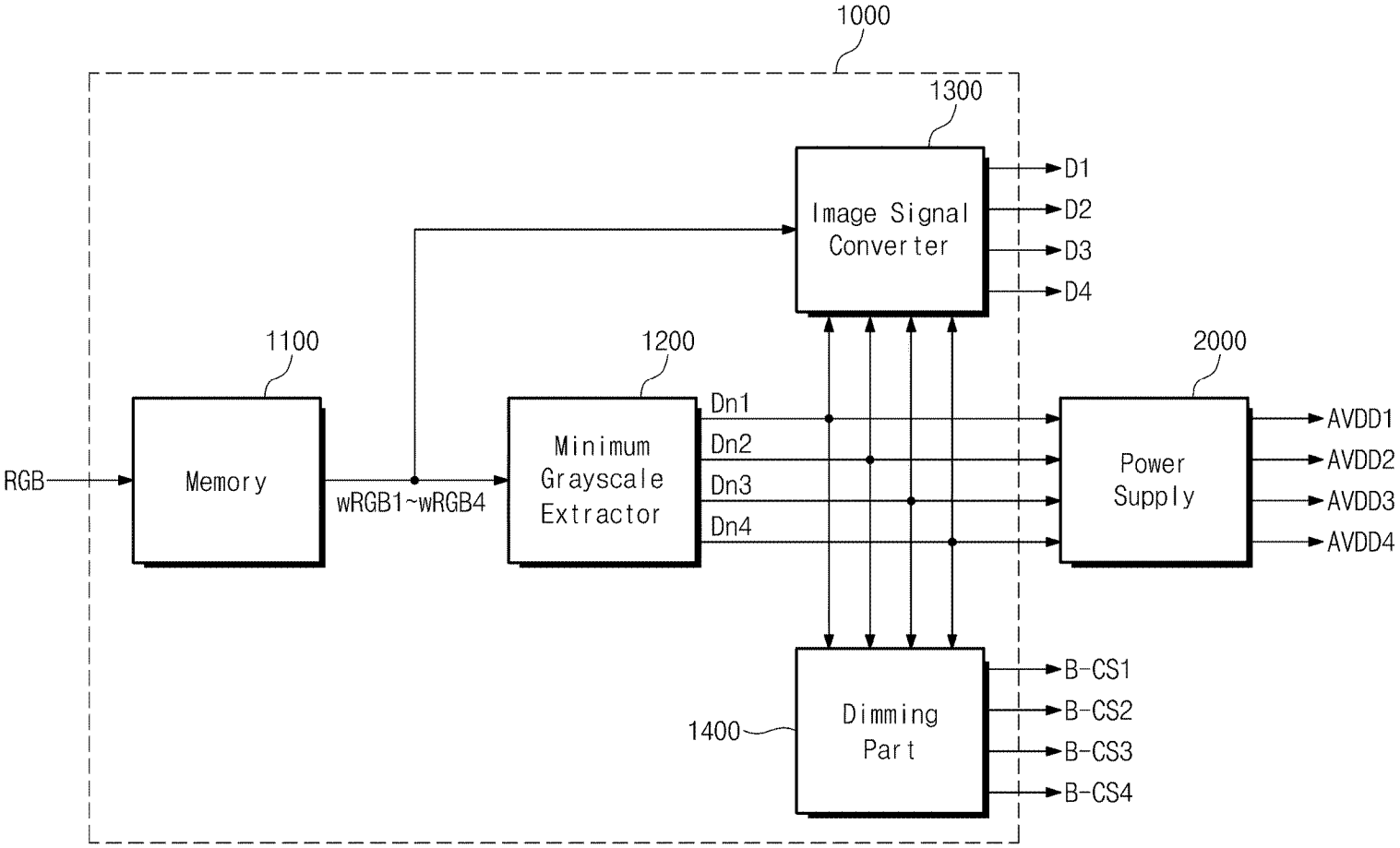
FIG. 14 is a block diagram showing a signal controller and a power supply according to another exemplary embodiment of the present disclosure.

FIG. 14 is a block diagram showing a signal controller and a power supply according to another exemplary embodiment of the present disclosure, and FIG. 15 is a table showing an operation of a signal controller and a backlight unit (e.g., a backlight source) according to another exemplary embodiment of the present disclosure.

A display device shown in FIGS. 14 and 15 may be operated in a normally white mode WB. The term "normally white mode WB" as used herein refers to a case where the grayscale level of the image signal corresponding to the data voltage is lowered as the level of the data voltage applied to the pixel decreases.

Referring to FIG. 14, a signal controller 1000 includes a memory 1100, a minimum grayscale extractor 1200, an image signal converter 1300, and a dimming part (e.g., a dimmer) 1400. The signal controller 1000 shown in FIG. 14 may have the same or substantially the same structure and function as those of the signal controller 110 shown in FIG. 3, except for the minimum grayscale extractor 1200.

The minimum grayscale extractor 1200 receives first to fourth group image signals wRGB1 to wRGB4 from the memory 1100. The minimum grayscale extractor 1200 extracts a first minimum grayscale image signal Dn1 having a minimum grayscale level (e.g., a lowest grayscale level) from among the first group image signals wRGB1. The minimum grayscale extractor 1200 extracts a second minimum grayscale image signal Dn2 having the minimum grayscale level (e.g., the lowest grayscale level) from among the second group image signals wRGB2. The minimum grayscale extractor 1200 extracts a third minimum grayscale image signal Dn3 having the minimum grayscale level (e.g., the lowest grayscale level) from among the third group image signals wRGB3. The minimum grayscale extractor 1200 extracts a fourth minimum grayscale image signal Dn4 having the minimum grayscale level (e.g., the lowest grayscale level) from among the fourth group image signals wRGB4.

The minimum grayscale extractor 1200 applies the first to fourth minimum grayscale image signals Dn1 to Dn4 extracted from the first to fourth group image signals wRGB1 to wRGB4 to each of the image signal converter 1300, the dimming part 1400, and a power supply 2000.

For example, the image signal converter 1300 converts the grayscale level of the first minimum grayscale image signal Dn1 having the minimum grayscale level from among the first group image signals wRGB1 toward a black grayscale level based on a reference gamma curve, to allow the first minimum grayscale image signal Dn1 to be expressed in the data driving circuit 300. In addition, the image signal converter 1300 converts the grayscale level of first group image signals wRGB1, except for the first minimum grayscale image signal Dn1, toward the black grayscale level based on the reference gamma curve, to allow the first group image signals wRGB1, except for the first minimum grayscale image signal Dn1, to be expressed in the data driving circuit 300.

That is, the image signal converter 1300 generates first converted image signals D1 obtained by controlling the first group image signals wRGB1 toward the black grayscale level based on the reference gamma curve. The image signal converter 1300 converts the second to fourth group image signals wRGB2 to wRGB4 to second to fourth converted image signals D2 to D4 using the above-mentioned method. Accordingly, detailed descriptions of the conversion of the second to fourth group image signals wRGB2 to wRGB4 to the second to fourth converted image signals D2 to D4 will be omitted.

The power supply 2000 shown in FIG. 14 receives the first to fourth minimum grayscale image signals Dn1 to Dn4 from the minimum grayscale extractor 1200. The power supply 2000 generates first to fourth gamma driving voltages AVDD1 to AVDD4 from the reference gamma driving voltage in response to the first to fourth minimum grayscale image signals Dn1 to Dn4.

According to an exemplary embodiment, the power supply 2000 generates the first to fourth gamma driving voltages AVDD1 to AVDD4, which have levels that are the same or substantially the same as each other or have at least one different level, in response to the first to fourth minimum grayscale image signals Dn1 to Dn4. That is, the power supply 2000 generates the gamma driving voltages having the level lower than that of the reference gamma driving voltage in accordance with the first to fourth minimum grayscale image signals Dn1 to Dn4. As a result, the overall power consumption of the display device may be reduced.

Referring to FIG. 15, in the case where the first minimum grayscale image signal Dn1 has the grayscale level between the minimum grayscale level (e.g., a 0 grayscale level) and the third reference grayscale level A, the signal controller 1000 generates the first light control signal B-CS1 to lower the brightness of the first light L1 from the maximum brightness. As a result, the first group light emitting diodes 510 emits the first light L1 having the brightness lowered to the third level (e.g., 25%) from the first level (e.g., 100%) in response to the first light control signal B-CS1. In addition, the power supply 2000 generates the first gamma driving voltage AVDD1 obtained by lowering a first driving voltage V2*a*, which is the reference gamma driving voltage, to a second driving voltage V2*b*.

For example, in the case where the third minimum grayscale image signal Dn3 has the grayscale level between the third reference grayscale level A and the second reference grayscale level B, the signal controller 1000 generates the third light control signal B-CS3 to lower the brightness of the third light L3 from the maximum brightness. As a result, the third group light emitting diodes 530 emits the third light L3 having the brightness lowered to the second level (e.g., 50%) from the first level (e.g., 100%) in response to the third light control signal B-CS3. In addition, the power supply 2000 maintains or substantially maintains the first driving voltage V2*a* that is the reference gamma driving voltage.

As an example, in the case where the fourth minimum grayscale image signal Dn4 has the grayscale level between the second reference grayscale level B and the first reference grayscale level C, the signal controller 1000 generates the fourth light control signal B-CS4 to maintain or substantially maintain the fourth light L4 at the maximum brightness. In addition, the power supply 2000 generates the fourth gamma driving voltage AVDD4 obtained by lowering the first driving voltage V2*a*, which is the reference gamma driving voltage, to the fourth driving voltage V2*d*.

The electronic or electric devices (e.g., the signal controller, the maximum grayscale extractor, the minimum grayscale extractor, the image signal converter, the dimming part, etc.) and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is to be understood that the present invention should not be limited to these exemplary embodiments, but that various changes and modifications may be made by one ordinary skilled in the art without departing from the spirit and scope of the present invention as defined by the following claims, and their equivalents.

What is claimed is:

1. A display device comprising:

a display panel comprising first group pixels connected to a first gate line to receive first data voltages, and second group pixels connected to the first gate line to receive second data voltages;

a backlight source configured to provide light to the display panel;

a signal controller configured to divide horizontal image signals into first group image signals and second group image signals, to extract a first maximum grayscale image signal from the first group image signals, and to extract a second maximum grayscale image signal from the second group image signals;

a power supply configured to generate first and second gamma driving voltages from a reference gamma driving voltage based on a grayscale level of the first maximum grayscale image signal and a grayscale level of the second maximum grayscale image signal;

a first data driving circuit configured to apply the first data voltages generated based on the first gamma driving voltage and the first group image signals to the first group pixels; and a second data driving circuit configured to apply the second data voltages generated based on the second gamma driving voltage and the second group image signals to the second group pixels.

2. The display device of claim 1, wherein the signal controller is configured to convert the first group image signals to first converted image signals based on the first maximum grayscale image signal, and to convert the second group image signals to second converted image signals based on the second maximum grayscale image signal.

3. The display device of claim 2, wherein the first data driving circuit is configured to generate the first data voltages based on the first converted image signals, and the second data driving circuit is configured to generate the second data voltages based on the second converted image signals.

4. The display device of claim 1, wherein the signal controller is configured to generate the first gamma driving voltage that is lower than the reference gamma driving voltage in accordance with the grayscale level of the first maximum grayscale image signal, and to generate the second gamma driving voltage that is lower than the reference gamma driving voltage in accordance with the grayscale level of the second maximum grayscale image signal.

5. The display device of claim 1, wherein the backlight source comprises first group light emitting diodes and second group light emitting diodes, the first group light emitting diodes being configured to provide a first light to the first group pixels in response to a first light control signal, and the second group light emitting diodes being configured to provide a second light to the second group pixels in response to a second light control signal.

6. The display device of claim 5, wherein the signal controller is configured to compare the grayscale level of the first maximum grayscale image signal with a reference grayscale level, and to output the first light control signal to control a brightness of the first light according to the comparison.

7. The display device of claim 6, wherein the signal controller is configured to generate the first light control signal to maintain the brightness of the first light at a maximum brightness and the power supply is configured to generate the first gamma driving voltage that is lower than the reference gamma driving voltage, when the grayscale level of the first maximum grayscale image signal is greater than or equal to the reference grayscale level.

8. The display device of claim 6, wherein the signal controller is configured to generate the first light control signal to lower the brightness of the first light from a maximum brightness and the power supply is configured to generate the reference gamma driving voltage as the first gamma driving voltage, when the grayscale level of the first maximum grayscale image signal is less than or equal to the reference grayscale level.

9. The display device of claim 6, wherein the signal controller is configured to generate the first light control signal to lower the brightness of the first light from a maximum brightness and the power supply is configured to generate the first gamma driving voltage that is lower than the reference gamma driving voltage, when the grayscale level of the first maximum grayscale image signal is less than or equal to the reference grayscale level.

10. A display device comprising:

a display panel comprising first group pixels connected to a first gate line to receive first data voltages, and second group pixels connected to the first gate line to receive second data voltages;

a backlight source configured to provide light to the display panel;

a signal controller configured to divide horizontal image signals into first group image signals and second group image signals, to extract a first maximum grayscale image signal from the first group image signals, and to extract a second maximum grayscale image signal from the second group image signals, wherein the signal controller comprises:

a memory configured to receive the horizontal image signals;

a maximum grayscale extractor configured to extract the first maximum grayscale image signal and the second maximum grayscale image signal;

an image signal converter configured to convert the first group image signals to first converted image signals based on the first maximum grayscale image signal, and to convert the second group image signals to second converted image signals based on the second maximum grayscale image signal; and a dimmer configured to control the backlight source in response to the first and second maximum grayscale image signals;

a power supply configured to generate first and second gamma driving voltages from a reference gamma driving voltage based on a grayscale level of the first maximum grayscale image signal and a grayscale level of the second maximum grayscale image signal;

a first data driving circuit configured to apply the first data voltages generated based on the first gamma driving voltage and the first group image signals to the first group pixels; and a second data driving circuit configured to apply the second data voltages generated based on the second gamma driving voltage and the second group image signals to the second group pixels.

11. The display device of claim 10, wherein the image signal converter comprises:

a look-up table configured to store the first converted image signals and the second converted image signals; and a register configured to extract the first converted image signals corresponding to the grayscale level of the first maximum grayscale image signal from among the first converted image signals stored in the look-up table, and to apply the extracted first converted image signals to the first data driving circuit.

12. The display device of claim 10, wherein the backlight source comprises a plurality of light emitting diodes, and the light emitting diodes are configured to provide the light to the first group pixels and the second group pixels in response to a light control signal.

13. The display device of claim 10, wherein the signal controller is configured to generate a light control signal to lower a brightness of the light from a maximum brightness and the power supply is configured to generate the first and second gamma driving voltages that are smaller than the reference gamma driving voltage, when the grayscale level of the first maximum grayscale image signal and the grayscale level of the second maximum grayscale image signal are less than or equal to a reference grayscale level.

14. The display device of claim 1, wherein the signal controller is configured to store at least one horizontal image signal based on a maximum variation amount of a grayscale level that is variable during a horizontal blank period.

15. The display device of claim 14, wherein the signal controller is configured to calculate a minimum gamma driving voltage that is utilized by each horizontal period based on the maximum variation amount of the grayscale level that is variable during the horizontal blank period, and the power supply is configured to compare the minimum gamma driving voltage that is utilized by each horizontal period and the first gamma driving voltage, and to apply one of the minimum gamma driving voltage and the first gamma driving voltage to the first data driving circuit according to the comparison.

16. A display device comprising:

a display panel comprising first group pixels connected to a first gate line to receive first data voltages, and second group pixels connected to the first gate line to receive second data voltages;

a backlight source configured to provide light to the display panel;

a signal controller configured to divide horizontal image signals into first group image signals and second group image signals, to extract a first minimum grayscale image signal from the first group image signals, and to extract a second minimum grayscale image signal from the second group image signals;

a power supply configured to generate first and second gamma driving voltages from a reference gamma driving voltage based on a grayscale level of the first minimum grayscale image signal and a grayscale level of the second minimum grayscale image signal;

a first data driving circuit configured to apply the first data voltages generated based on the first gamma driving voltage and the first group image signals to the first group pixels; and a second data driving circuit configured to apply the second data voltages generated based on the second gamma driving voltage and the second group image signals to the second group pixels.

17. The display device of claim 16, wherein the signal controller is configured to convert the first group image signals to first converted image signals based on the first minimum grayscale image signal, and the first data driving circuit is configured to generate the first data voltages based on the first converted image signals.

18. The display device of claim 16, wherein the backlight source comprises first group light emitting diodes and second group light emitting diodes, the first group light emitting diodes are configured to provide a first light to the first group pixels in response to a first light control signal, and the second group light emitting diodes are configured to provide a second light to the second group pixels in response to a second light control signal.

19. The display device of claim 18, wherein the signal controller is configured to generate the first light control signal to lower a brightness of the first light from a maximum brightness and the power supply is configured to generate the reference gamma driving voltage as the first gamma driving voltage, when the grayscale level of the first minimum grayscale image signal is less than or equal to a reference grayscale level.

20. The display device of claim 18, wherein the signal controller is configured to generate the first light control signal to maintain a brightness of the first light at a maximum brightness and the power supply is configured to generate the first gamma driving voltage to lower the reference gamma driving voltage, when the grayscale level of the first minimum grayscale image signal is greater than or equal to a reference grayscale level.

* * * * *